US012084847B2

(12) United States Patent
Shiohara et al.

(10) Patent No.: US 12,084,847 B2
(45) Date of Patent: Sep. 10, 2024

(54) FLUSH TOILET

(71) Applicant: TOTO LTD., Kitakyushu (JP)

(72) Inventors: Eiji Shiohara, Fukuoka (JP); Yusuke Tone, Fukuoka (JP); Masaaki Momoe, Fukuoka (JP); Kazuya Esaki, Fukuoka (JP); Masaki Mori, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/588,364

(22) Filed: Jan. 31, 2022

(65) Prior Publication Data

US 2022/0316199 A1 Oct. 6, 2022

(30) Foreign Application Priority Data

Mar. 30, 2021 (JP) ..... 2021-056445

(51) Int. Cl.
*E03D 11/13* (2006.01)

(52) U.S. Cl.
CPC ..... *E03D 11/13* (2013.01)

(58) Field of Classification Search
CPC ..... E03D 11/13
USPC ..... 4/420; 292/251.5
See application file for complete search history.

(56) References Cited

U.S. PATENT DOCUMENTS 2,508,305 A * 5/1950 Teetor ..... E05C 19/16 206/818
2,693,382 A * 11/1954 Teetor ..... E05C 19/16 292/251.5
2,719,050 A * 9/1955 Teetor ..... E05C 19/16 292/144
3,600,025 A * 8/1971 Brainard ..... E05C 19/165 292/251.5
4,090,265 A * 5/1978 Baus ..... E05D 15/08 4/557
4,527,311 A * 7/1985 Aoki ..... A44C 5/2042 24/303

(Continued)

FOREIGN PATENT DOCUMENTS

JP 57-089665 6/1982
JP 09-108151 4/1997

(Continued)

OTHER PUBLICATIONS

Japanese Office Action for Japanese Patent Application No. 2021-056445 dated Jul. 12, 2022.

(Continued)

*Primary Examiner* — David P Angwin
*Assistant Examiner* — William R Klotz
(74) *Attorney, Agent, or Firm* — Amin, Turocy & Watson, LLP

(57) ABSTRACT

A flush toilet includes a toilet body that includes a bowl part that receives waste, a functional part that is provided on a back side of the toilet body, a panel member that covers a side surface of the functional part, a magnet that is provided on one of the panel member and the toilet body, and a magnetic body that is provided on another of the panel member and the toilet body, where at least one of the panel member and the toilet body includes an attachment part that includes a recessed part for attaching the magnet or the magnetic body to the attachment part.

9 Claims, 9 Drawing Sheets

(56) References Cited

U.S. PATENT DOCUMENTS

| | | | | | |
|---|---|---|---|---|---|
| 4,700,436 | A | * | 10/1987 | Morita | A45C 13/1069 24/303 |
| 4,779,314 | A | * | 10/1988 | Aoki | A41F 1/002 24/303 |
| 5,190,325 | A | * | 3/1993 | Doss-Desouza | E05C 19/16 292/DIG. 60 |
| 5,249,338 | A | * | 10/1993 | Aoki | H01F 7/0263 24/303 |
| 5,572,773 | A | * | 11/1996 | Bauer | A41F 1/002 24/303 |
| 5,707,091 | A | * | 1/1998 | Morita | E05C 19/16 24/303 |

FOREIGN PATENT DOCUMENTS

| | | |
|---|---|---|
| JP | 2007-262701 | 10/2007 |
| JP | 2008-303712 | 12/2008 |
| JP | 2020-165173 | 10/2020 |
| KR | 10-2014-0067779 | 6/2014 |

OTHER PUBLICATIONS

Japanese Decision to Grant a Patent for Japanese Patent Application No. 2021-056445 dated Sep. 27, 2022.

* cited by examiner

FLUSH TOILET

CROSS-REFERENCE TO RELATED APPLICATION(S)

The present application claims the benefit of priority to Japanese Patent Application No. 2021-056445 filed on Mar. 30, 2021, the entire contents of which Japanese Patent Application are incorporated by reference in the present application.

FIELD

A disclosed embodiment(s) relate(s) to a flush toilet.

BACKGROUND

For a flush toilet with a functional part that is covered by a panel member, a method has conventionally been known that uses magnetic force in order to hold the panel member on the flush toilet (see, for example, Japanese Patent Application Publication No. 2020-165173).

However, a volume of a magnet has to be increased in order to hold a panel member by magnetic force thereof, so that such a magnet is upsized in a width direction of a toilet body. Thereby, when a panel member is attached to a toilet body, the panel member protrudes relative to a toilet body in a width direction thereof so as to provide a step therebetween and degrade an appearance thereof.

SUMMARY

A flush toilet according to an aspect of an embodiment includes a toilet body that includes a bowl part that receives waste, a functional part that is provided on a back side of the toilet body, a panel member that covers a side surface of the functional part, a magnet that is provided on one of the panel member and the toilet body, and a magnetic body that is provided on another of the panel member and the toilet body, wherein at least one of the panel member and the toilet body includes an attachment part that includes a recessed part for attaching the magnet or the magnetic body to the attachment part.

BRIEF DESCRIPTION OF DRAWING(S)

DESCRIPTION OF EMBODIMENT(S)

Hereinafter, an outline of a flush toilet 1 according to an embodiment will be explained with reference to the accompanying drawing(s).

Figure 1:
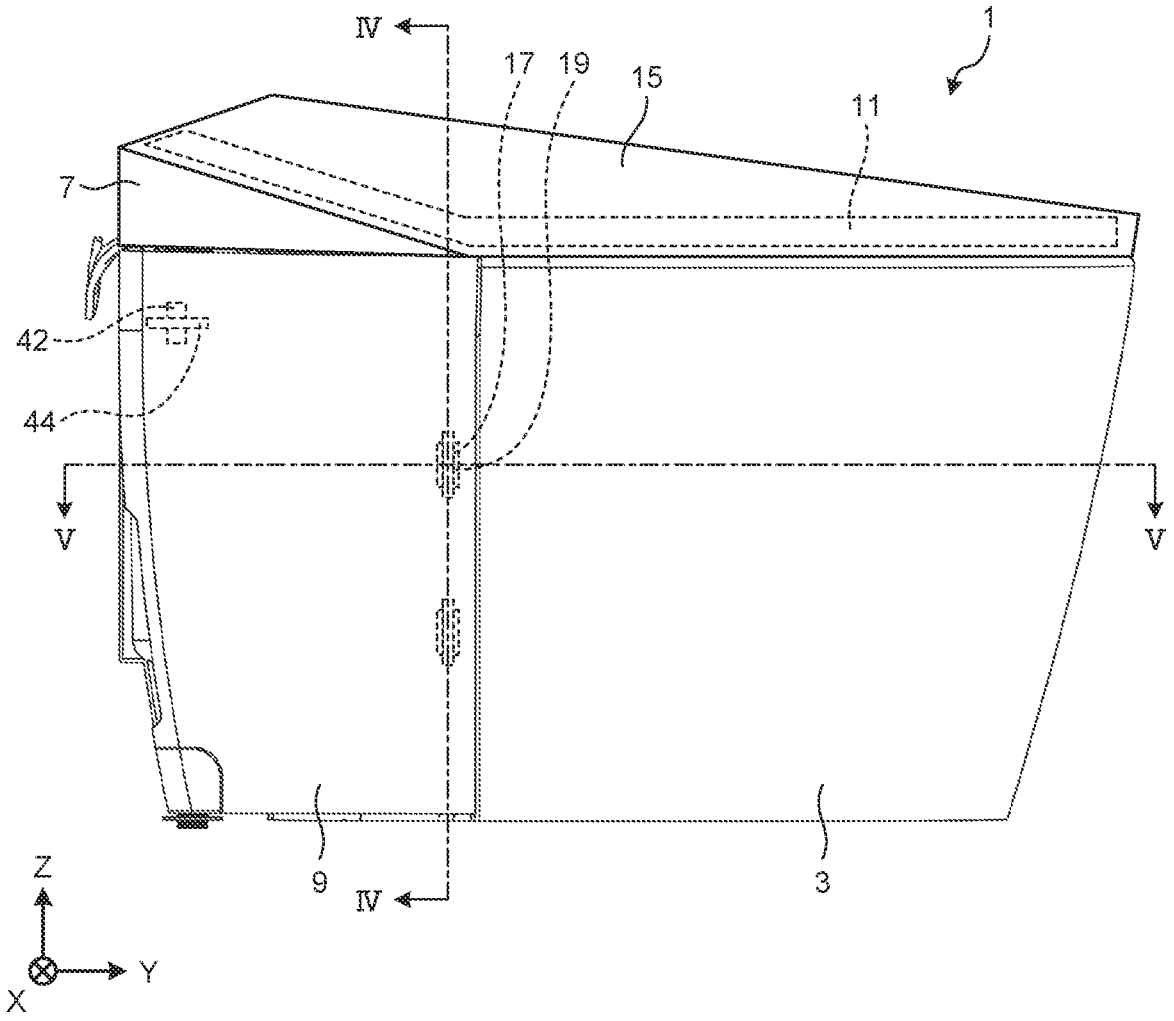
FIG. 1 is a side view of a flush toilet according to a first embodiment.

Additionally, in respective figurers that include FIG. 1, a three-dimensional orthogonal coordinate system that includes a Z-axis where a vertically upward (an upward) direction is provided as a positive direction may be illustrated for explanatory convenience. In such a case, a positive direction of an X-axis, a negative direction of the X-axis, a positive direction of a Y-axis, a negative direction of the Y-axis, a positive direction of a Z-axis, and a negative direction of the Z-axis are defined as being leftward, rightward, frontward, backward, upward, and downward, and further, X-axis directions, Y-axis directions, and Z-axis directions are referred to as leftward and rightward directions, frontward and backward directions, and upward and downward directions.

First Embodiment

Figure 2:
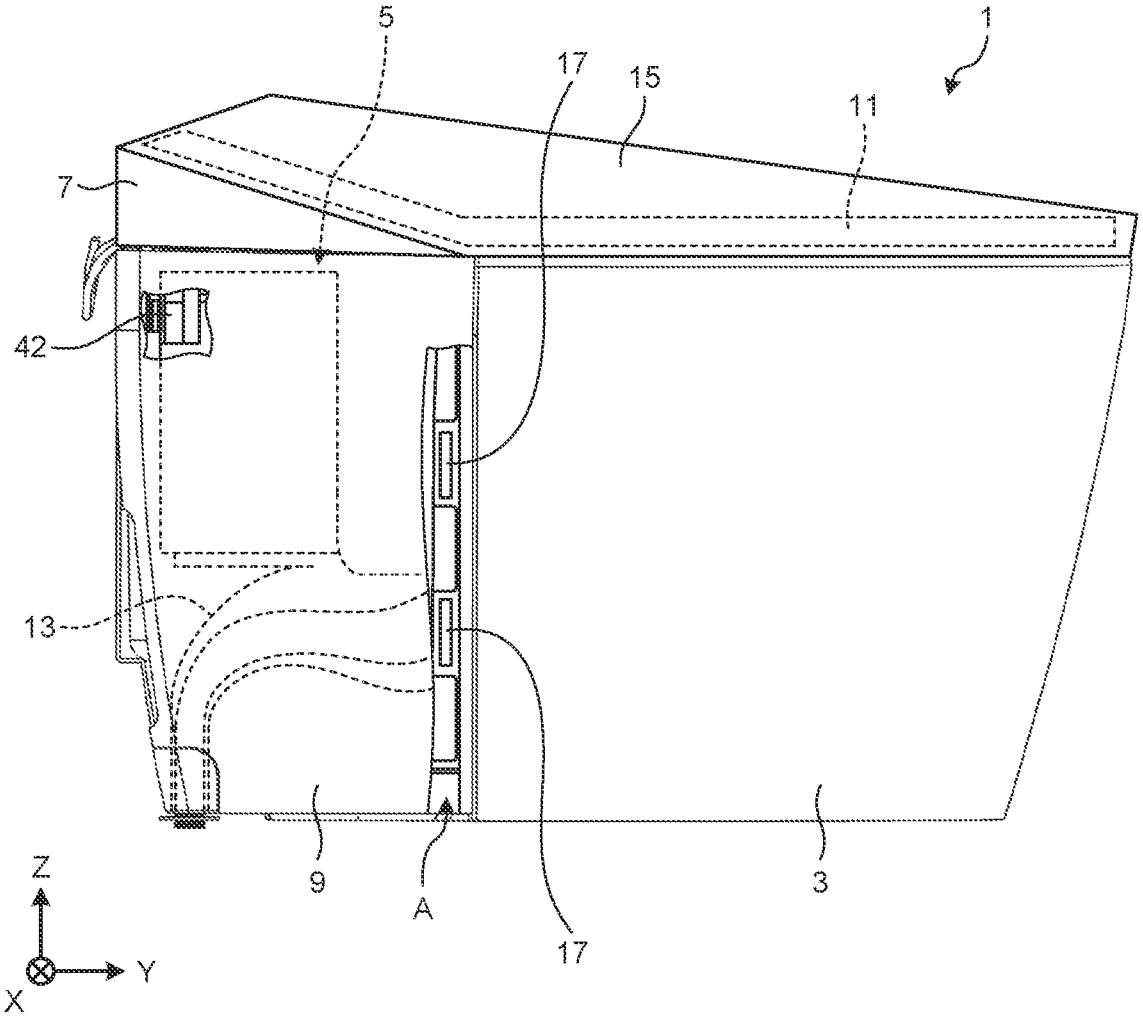
FIG. 2 is a side view where a part of a panel member and the like of a flush toilet according to a first embodiment are omitted.

As illustrated in FIG. 1 and FIG. 2, the flush toilet 1 includes a toilet body 3, a functional part 5, a sanitary washing device 7, a panel member 9, and a toilet seat part 11. The toilet body 3 is made of a ceramic. Additionally, the toilet body 3 that is made of a ceramic is not limiting where, for example, it may be made of a resin or may be a combination of a ceramic and a resin. FIG. 1 is a side view of the flush toilet 1 according to a first embodiment. FIG. 2 is a side view where a part of the panel member 9 and the like of the flush toilet 1 according to a first embodiment are omitted.

The toilet body 3 has a bowl part (non-illustrated) and a drainage water trap pipeline 13.

The functional part 5 is provided on a back side of the toilet body 3. The functional part 5 executes water supply to a bowl part of the toilet body 3 and/or the sanitary washing device 7. The functional part 5 includes a water storage tank (non-illustrated), a pressurization pump (non-illustrated), and the like. In the functional part 5, for water supply, washing water that is stored in a water storage tank is pressurized by a pressurization pump, so that a high flow volume thereof is spouted from a jet water spout port (non-illustrated) to a bowl part.

The sanitary washing device 7 is provided with a private part washing device (non-illustrated) that includes a nozzle device (non-illustrated) that jets washing water toward a private part of a user on an upper side of a bowl part. Furthermore, the sanitary washing device 7 is provided with a water storage part (non-illustrated) that stores washing water that is supplied to a private part washing device, a heater (non-illustrated) that warms washing water in the water storage part to suitable temperature so as to provide warm water, a ventilation fan (non-illustrated), a deodorization fan (non-illustrated), a hot air fan (non-illustrated), a control part (non-illustrated) that controls each of these parts, and the like.

The toilet seat part 11 is arranged on an upper part of the toilet body 3 and a user is seated thereon in a case where the flush toilet 1 is used thereby. The toilet seat part 11 is rotated around a back side thereof as a point of support so as to be capable of being opened and closed.

A lid part 15 is arranged on a front side of the toilet body 3 similarly to the toilet seat part 11 and covers an upper surface of the toilet body 3 that includes a bowl part thereof from an upper side thereof. The lid part 15 is rotated around a back side thereof as a point of support so as to be capable of being opened and closed, similarly to the toilet seat part 11. Additionally, the lid part 15 in a closed state thereof covers an upper surface of the toilet body 3 from an upper side thereof and covers the toilet seat part 11 from an upper side thereof.

A bowl part is a site that receives waste and is formed into a recess shape. A rim part (non-illustrated) is formed on an upper edge part of a bowl part. A rim part has a rim water spout port (non-illustrated) that spouts washing water. Washing water that is spouted from a rim water spout port of a rim part flows along an upper edge part of a bowl part so as to form a swirling flow in the bowl part. Additionally, a water conduit (non-illustrated) that is formed on an upstream side is connected to a rim water spout port and washing water from a washing water supply device (non-illustrated) is supplied through the water conduit.

The panel member 9 for preventing an external obstacle on and/or sewage penetration to the functional part 5 is provided on a back side of the toilet body 3 and a side surface of the functional part 5. The panel member 9 is attached to the toilet body 3 and the functional part 5 by magnets 19, 44 and metal plates 17, 42 that are adsorbed on the magnets 19, 44 by magnetic force thereof.

Figure 3:
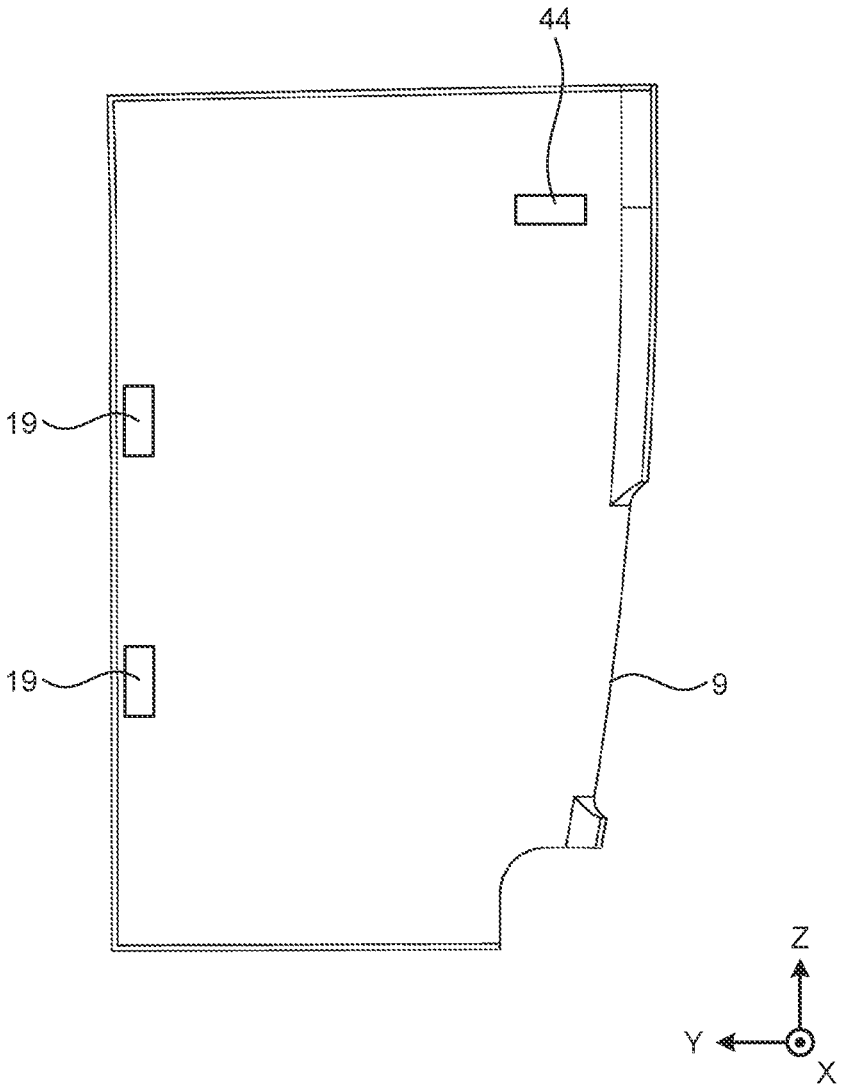
FIG. 3 is a side view from an inside of a panel member.
Figure 4:
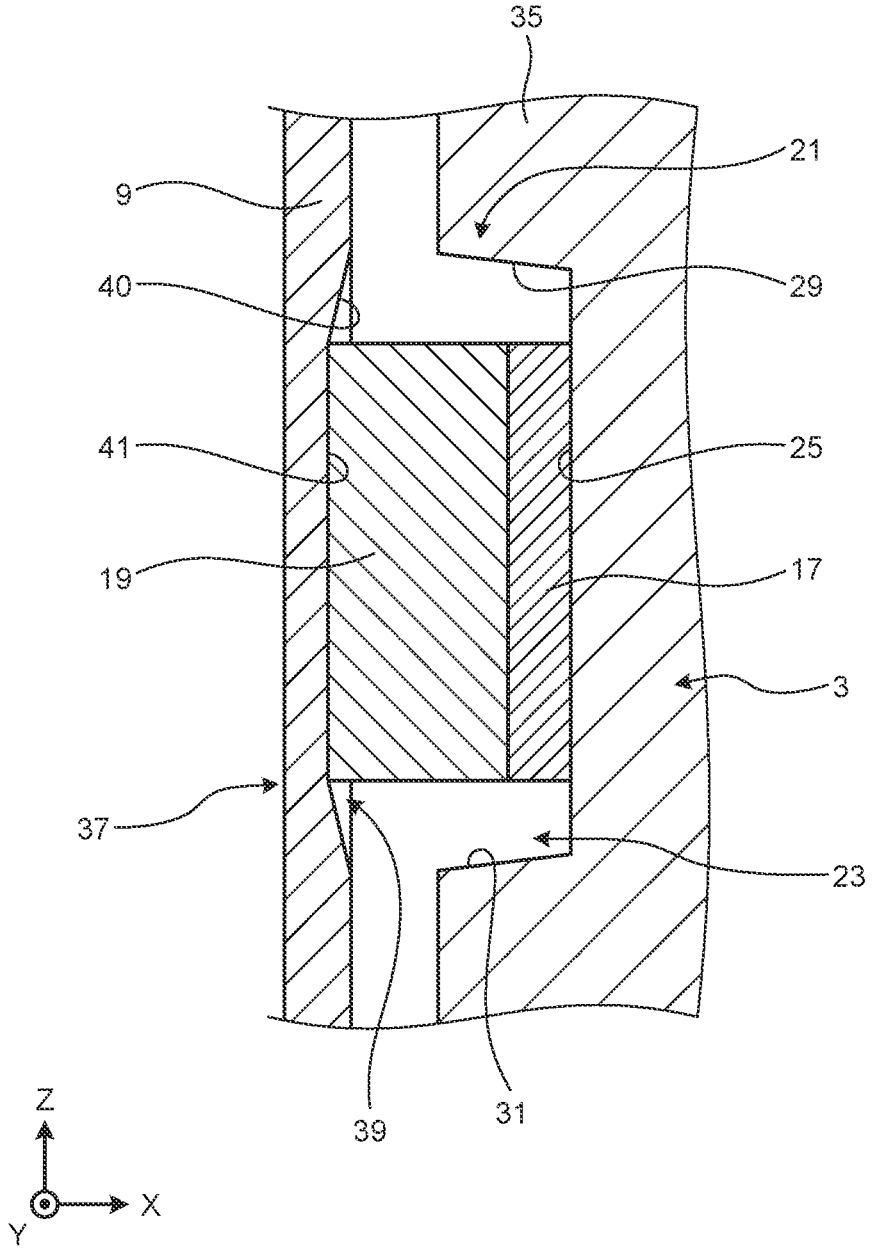
FIG. 4 is a schematic diagram near a magnet and a metal plate in a IV-IV cross section that is illustrated in FIG. 1.
Figure 5:
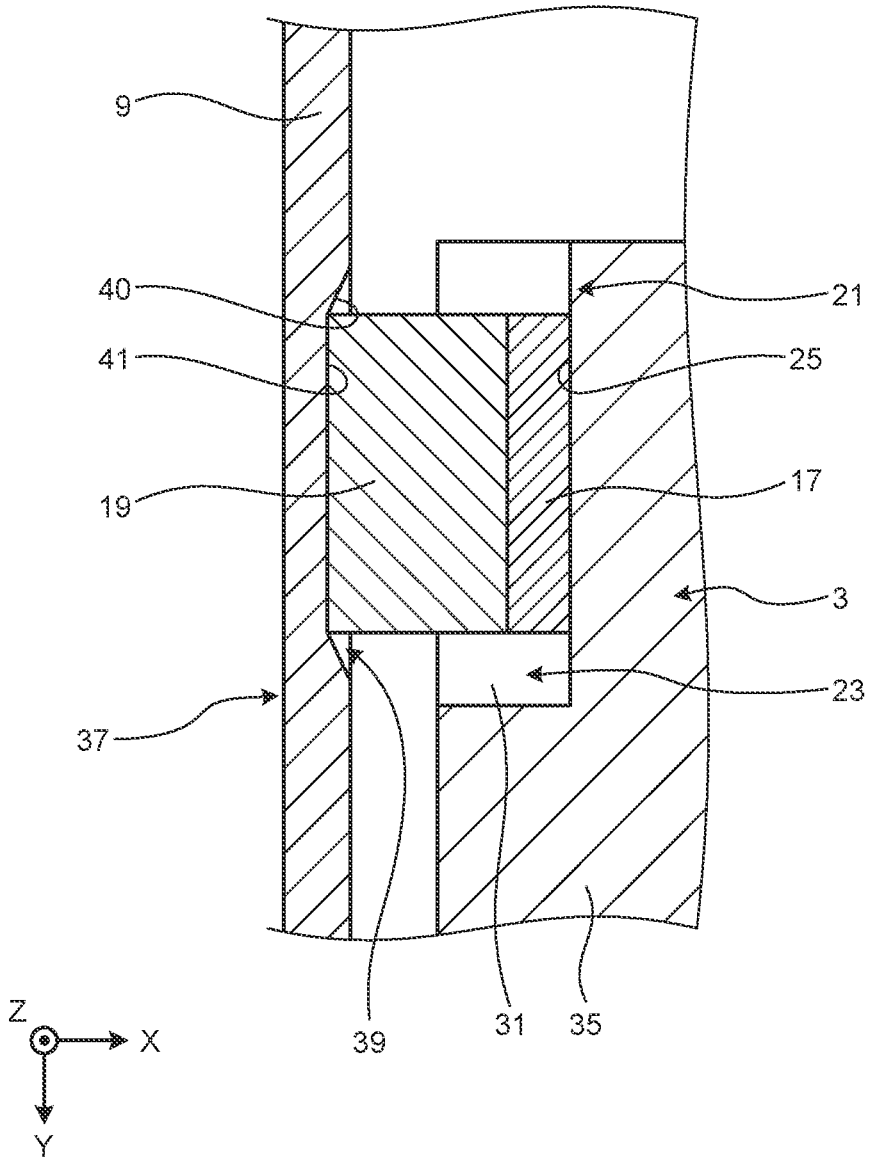
FIG. 5 is a schematic diagram near a magnet and a metal plate in a V-V cross section that is illustrated in FIG. 1.

Next, attachment of a panel member 9 to a toilet body 3 will be explained with reference to FIG. 2 to FIG. 5. FIG. 3 is a side view of the panel member 9 from an inside thereof. FIG. 4 is a schematic diagram near a magnet 19 and a metal plate 17 in a IV-IV cross section that is illustrated in FIG. 1. FIG. 5 is a schematic diagram near the magnet 19 and the metal plate 17 in a V-V cross section that is illustrated in FIG. 1.

The toilet body 3 includes the metal plate 17 that is a magnetic body that is adsorbed by magnetic force and the panel member 9 includes the magnet 19. As a detailed explanation is provided, when the panel member 9 is properly placed on the toilet body 3, the metal plate 17 is arranged on a boundary part A where the panel member 9 overlaps with the toilet body 3. The metal plate 17 is arranged at two places on the toilet body 3 along upward and downward directions. When the panel member 9 is properly placed on the toilet body 3, the magnet 19 is arranged at two places at positions that correspond to those of the metal plate 17. In detail, arrangement is executed at two places on a front end of an inner side surface of the panel member 9 along upward and downward directions of the panel member 9.

The metal plate 17 that is attached to the toilet body 3 will be explained in detail. When a side of the toilet body 3 is viewed, a length of the metal plate 17 in frontward and backward directions is less than or equal to a length of the boundary part A in frontward and backward directions. For example, a length of the metal plate 17 in frontward and backward directions is substantially equal to a length of the boundary part A in frontward and backward directions.

Then, a relationship of attachment of the toilet body 3 and the metal plate 17 will be explained.

The metal plate 17 is attached to a toilet-body-side attachment part 21 that is provided on the toilet body 3. Specifically, the metal plate 17 is attached to a toilet-body-side recessed part 23 (a recessed part) that is formed on the toilet-body-side attachment part 21 (an attachment part). The toilet-body-side attachment part 21 is provided on the boundary part A. Furthermore, a place other than the toilet-body-side attachment part 21 on the boundary part A is called a non-toilet-body-side attachment part 35. Each of the metal plate 17 and the toilet-body-side attachment part 21 is provided at two places. The metal plate 17 is attached to a side surface of the toilet body 3 at the boundary part A.

The toilet-body-side recessed part 23 is formed in such a manner that a part of the toilet body 3 at the boundary part A is dented inward. The toilet-body-side recessed part 23 is formed of a side surface 25, an upper surface 29, and a lower surface 31. The side surface 25 is a surface that extends in frontward and backward directions. The side surface 25 is an attachment surface where the metal plate 17 is attached thereto. Hereinafter, the upper surface 29 of the toilet-body-side recessed part 23 and the lower surface 31 thereof are called an upper side supporting surface 29 and a lower side supporting surface 31. Additionally, any toilet-body-side recessed part 23 may be provided where a part of the toilet body 3 is dented inward. The toilet-body-side recessed part 23 may be provided with a shape in such a manner that at least one of the upper surface 29 and the lower surface 31 slopes and is connected to another of the upper surface 29 and the lower surface 31. That is, the toilet-body-side recessed part 23 may be formed into a triangular shape that does not have the side surface 25.

Furthermore, the toilet-body-side recessed part 23 may be provided with a shape in such a manner that the upper surface 29 gently slopes and is continuous with the side surface 25. For example, the upper surface 29 and the side surface 25 may be connected through a curved surface. Furthermore, the toilet-body-side recessed part 23 may be provided with a shape in such a manner that the lower surface 31 gently slopes and is continuous with the side surface 25. Furthermore, the toilet-body-side recessed part 23 may be formed into a bowl shape. For example, the toilet-body-side recessed part 23 may be provided with a shape that has a bottom part (a side surface) with a U-shape.

Then, a relationship of attachment of the toilet-body-side attachment part 21 and the metal plate 17 will be explained. An amount of a recess on the toilet-body-side recessed part 23 in leftward and rightward directions is an amount that is capable of preventing dropping of the metal plate 17 therefrom. Additionally, the lower side supporting surface 31 does not have to contact the metal plate 17 where, even if a slight amount of a gap between the lower side supporting surface 31 and the metal plate 17 is provided, it is possible to expect effect of prevention of dropping of the metal plate 17 therefrom.

The lower side supporting surface 31 is smoothly connected to the side surface 25, so that a change of a curvature thereof relative to that of the side surface 25 is greater than 1. Furthermore, a tip of the lower side supporting surface 31 is connected to the non-toilet-body-side attachment part 35. Furthermore, in detail, the lower side supporting surface 31 extends from the side surface 25 toward an obliquely downward direction. A length of the lower side supporting surface 31 in leftward and rightward directions is greater than a thickness of the metal plate 17 in leftward and rightward directions.

The upper side supporting surface 29 will be explained in detail. The upper side supporting surface 29 is smoothly connected to the side surface 25, so that a change of a curvature thereof relative to that of the side surface 25 is greater than 1. Furthermore, a tip of the upper side supporting surface 29 is connected to the non-toilet-body-side attachment part 35. Furthermore, in detail, the upper side supporting surface 29 extends from the side surface 25 toward an obliquely upward direction. A length of the upper side supporting surface 29 in leftward and rightward directions is greater than a thickness of the metal plate 17 in leftward and rightward directions.

A fixation method for the toilet-body-side recessed part 23 and the metal plate 17 will be explained. A ceramic adhesive is applied to an inside of the toilet-body-side recessed part 23 and the metal plate 17 is put into the inside of the toilet-body-side recessed part 23, so that the metal plate 17 is fixed by bonding force that is provided by the ceramic adhesive and fitting thereof.

Thereby, a whole of the metal plate 17 is contained in the toilet-body-side recessed part 23, so that it is possible to decrease a step between the toilet body 3 and the panel member 9 without changing a size of the metal plate 17 and hence it is possible to attain improvement of a design thereof.

Then, the magnet 19 that is attached to the panel member 9 will be explained in detail.

When a side of the toilet body 3 is viewed, a length of the magnet 19 in frontward and backward directions is less than or equal to a length of the boundary part A in frontward and backward directions. For example, a length of the metal plate 17 in frontward and backward directions is substantially equal to a length of the boundary part A in frontward and backward directions.

Then, a relationship of attachment of the panel member 9 and the magnet 19 will be explained. The magnet 19 is attached to a panel-member-side attachment part 37 (an attachment part) that is provided on the panel member 9. Specifically, the magnet 19 is attached to a panel-member-side recessed part 39 (a recessed part) that is formed on the panel-member-side attachment part 37. The panel-member-side attachment part 37 is attached to a front side of an inner side surface of the panel member 9.

The panel-member-side recessed part 39 is formed in such a manner that a part of the panel member 9 at the boundary A is dented toward an outward direction of the panel member 9. Each of the magnet 19 and the panel-member-side attachment part 37 is provided at two places.

Thereby, a part of the magnet 19 is contained in the panel-member-side recessed part 39. In the flush toilet 1, it is possible to decrease a step between the toilet body 3 and the panel member 9 without decreasing a size of the magnet 19, that is, without decreasing magnetic force thereof. Hence, improvement of a design thereof is attained.

Furthermore, a panel member inner side surface 40 that forms the panel-member-side recessed part 39 slopes in such a manner that a thickness of the panel member 9 gradually increases with increasing a distance of from an edge of an attachment surface 41 where the magnet 19 is attached thereto. Thereby, even if the panel member 9 that has the panel-member-side recessed part 39 is molded in order to increase a thickness of the magnet 19, it is possible to suppress a recess that is generated by molding shrinkage and called sink.

Then, a relationship at a time when the panel member 9 is attached to the toilet body 3 will be explained. When the magnet 19 of the panel member 9 is attached to the metal plate 17 of the toilet-body-side recessed part 23, a part of the magnet 19 is put into an inside thereof from a tip part of the upper side supporting surface 29 of the toilet-body-side recessed part 23 and a tip part of the lower side supporting surface 31 thereof in a front view. Thereby, when the panel member 9 hangs by its own weight, the magnet 19 that is attached to the panel-member-side attachment part 37 contacts the lower side supporting surface 31 of the toilet-body-side attachment part 21. Hence, it is possible to suppress an amount of a shift of the panel member 9 relative to the toilet body 3 that is caused by its own weight. Furthermore, when the panel member 9 is cleaned by wiping thereof, and in a case where the panel member 9 is moved relative to the toilet body 3, the magnet 19 that is attached to the panel-member-side attachment part 37 contacts the upper side supporting surface 29 and/or the lower side supporting surface 31 of the toilet-body-side attachment part 21. Hence, it is possible to prevent the panel member 9 from dropping from the toilet body 3.

Furthermore, in the toilet body 3, a length between the lower side supporting surface 31 and the upper side supporting surface 29 increases toward a side of the panel member 9. Hence, when the panel member 9 is attached to the toilet body 3, the magnet 19 that is attached to the panel member 9 is guided to the toilet-body-side recessed part 23 by the lower side supporting surface 31 and the upper side supporting surface 29. That is, an operation of attachment of the panel member 9 thereto is facilitated.

Additionally, numbers and/or arrangement of the magnet 19 and the metal plate 17 is/are not limited thereto and is/are appropriately changed by a magnitude of magnetic force thereof, a weight of the panel member 9, and/or the like. Furthermore, a length of the metal plate 17 is not limited thereto where any shape and/or number thereof may be provided as long as the metal plate 17 is provided at a position of the magnet 19 at a time when the panel member 9 is attached to the toilet body 3 at a proper position. Furthermore, the magnet 19 may be included in the toilet body 3 and the metal plate 17 that is a magnetic body may be included in the panel member 9. Furthermore, a magnet may be used instead of the metal plate 17 that is a magnetic body. Furthermore, the lower side supporting surface 31 and the upper side supporting surface 29 may extend so as to be orthogonal to the side surface 25.

Figure 6:
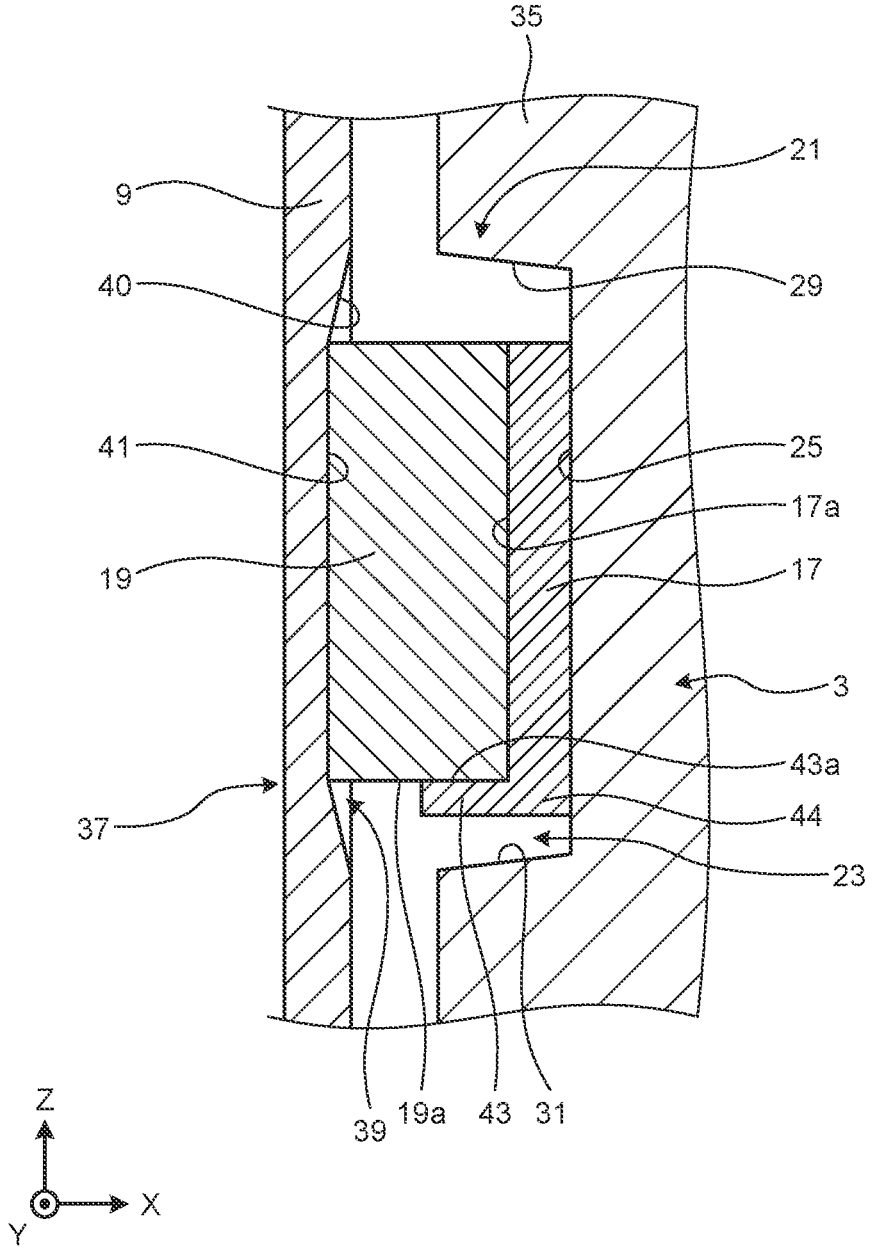
FIG. 6 is a cross-sectional view that illustrates a metal plate of a flush toilet according to a variation.

As illustrated in FIG. 6, a metal plate 17 of a flush toilet 1 according to a variation includes a protrusion part 43. FIG. 6 is a cross-sectional view that illustrates the metal plate 17 of the flush toilet 1 according to a variation. FIG. 6 is a cross-sectional view of a place that corresponds to FIG. 4 in the flush toilet 1 according to a variation. The metal plate 17 is provided with the protrusion part 43 that extends perpendicularly (in an X-direction in FIG. 6) relative to a metal plate side surface 17*a* of the metal plate 17, on a lower side of a magnet lower surface 19*a* of a magnet 19. When a panel member 9 is attached to a toilet body 3, an upper surface 43*a* of the protrusion part 43 contacts the magnet lower surface 19*a* of the magnet 19. Thereby, even if the panel member 9 is shifted downward by its own weight, the protrusion part 43 contacts the magnet lower surface 19*a* of the magnet 19 and the magnet 19 is supported thereby, so that it is possible to suppress a shift of the panel member 9. Additionally, although the protrusion part 43 extends perpendicularly from the metal plate side surface 17*a* of the metal plate 17 in FIG. 6, the metal plate side surface 17*a* of the metal plate 17 and the upper surface 43*a* of the protrusion part 43 may have a curvature(s) thereof. That is, the protrusion part 43 may be formed so as to be curved.

Figure 7:
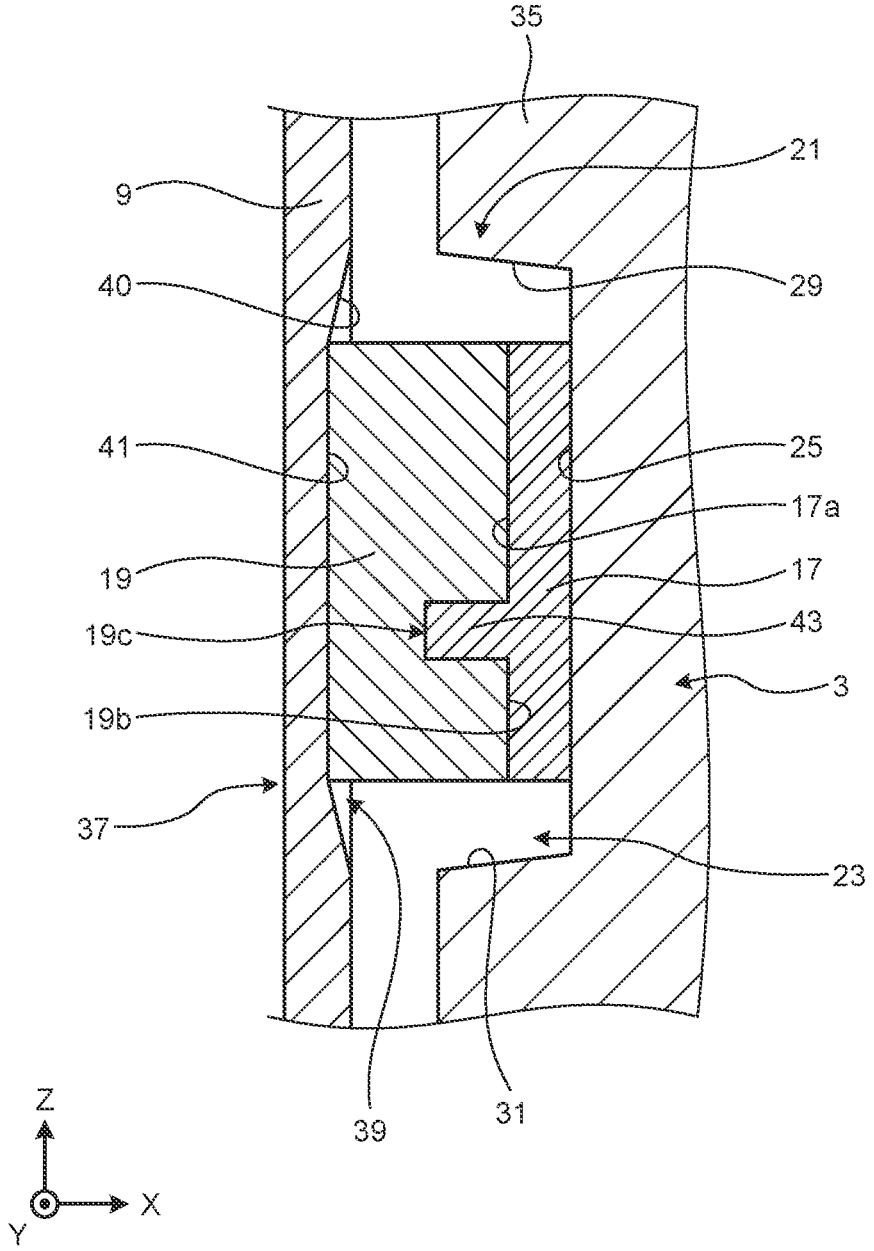
FIG. 7 is a cross-sectional view of a place that corresponds to FIG. 4 in a flush toilet according to a variation.

As illustrated in FIG. 7, a protrusion part 43 of a metal plate 17 of a flush toilet 1 according to a variation may be inserted into a magnet 19. FIG. 7 is a cross-sectional view of a place that corresponds to FIG. 4, in the flush toilet 1 according to a variation. A magnet side surface 19*b* of the magnet 19 is provided with a magnet dent part 19*c* and a metal plate side surface 17*a* of the metal plate 17 is provided with the protrusion part 43. When a panel member 9 is attached to a toilet body 3, the protrusion part 43 is put into the magnet dent part 19*c* of the magnet 19 and the protrusion part 43 contacts an upper surface of the magnet dent part 19*c* so as to support the magnet 19, so that it is possible to suppress a shift of the panel member 9.

Second Embodiment

Figure 8:
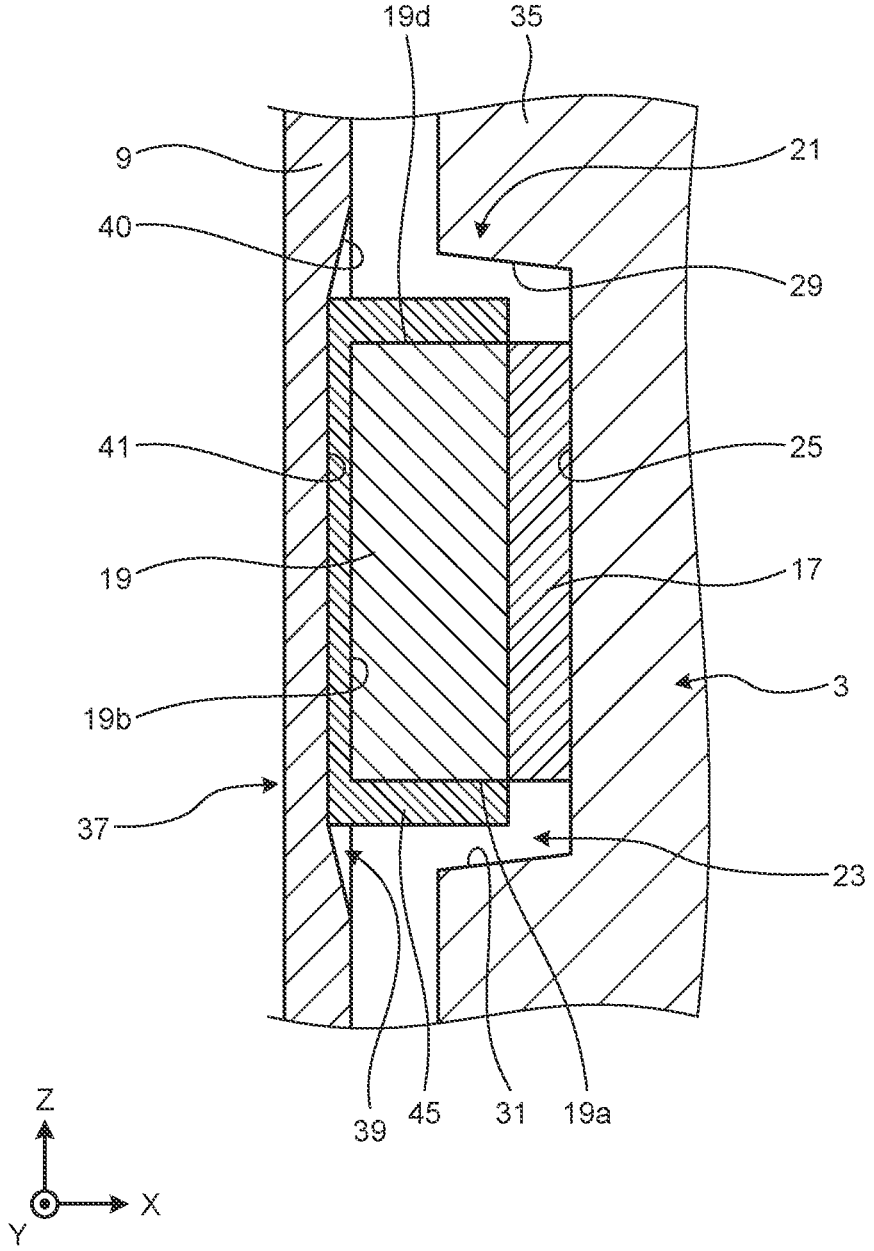
FIG. 8 is a cross-sectional view of a place that corresponds to FIG. 4 in a flush toilet according to a second embodiment.
Figure 9:
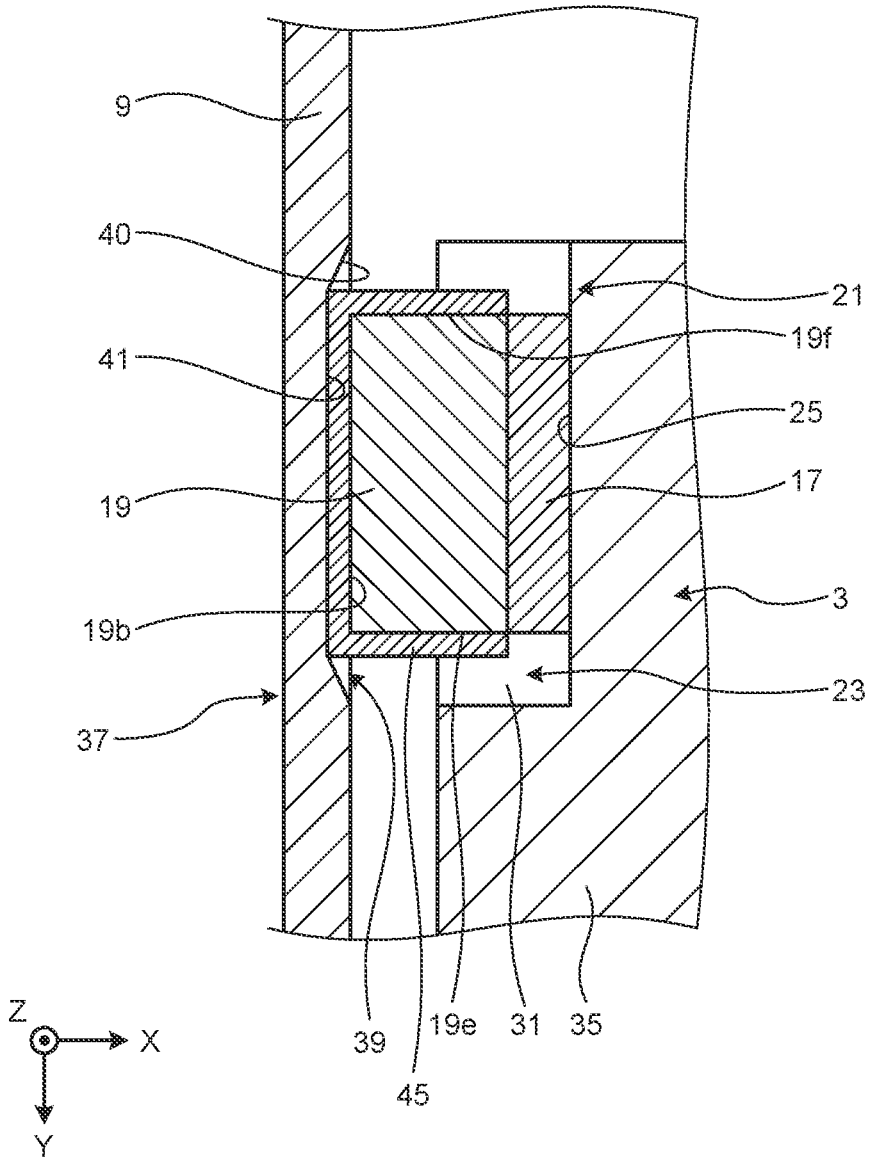
FIG. 9 is a cross-sectional view of a place that corresponds to FIG. 5 in a flush toilet according to a second embodiment.

Next, a flush toilet 1 according to a second embodiment will be explained by using FIG. 8 to FIG. 9. Herein, a place that is different from that of the first embodiment will be explained. FIG. 8 is a cross-sectional view of a place that corresponds to FIG. 4, in the flush toilet 1 according to a second embodiment. FIG. 9 is a cross-sectional view of a place that corresponds to FIG. 5, in the flush toilet 1 according to a second embodiment.

Furthermore, a yoke 45 is attached to a magnet 19 according to a second embodiment. The yoke 45 is provided so as to cover a periphery of the magnet 19. Specifically, the yoke 45 is provided so as to cover a magnet lower surface 19*a*, a magnet side surface 19*b*, a magnet upper surface 19*d*, a magnet front surface 19*e*, and a magnet back surface 19*f*. The yoke 45 is attached to a panel member 9. The yoke 45 is attached to a panel-member-side recessed part 39 of the panel member 9.

The yoke 45 covers a periphery of the magnet 19, so that a magnetic circuit is configured where a magnetic flux is concentrically output from the yoke 45. In a case where the magnet 19 that is covered with the yoke 45 is attached to a toilet body 3, the yoke 45 is enclosed in a toilet-body-side attachment part 21 in a side view. Specifically, a part of the yoke 45 is contained in a toilet-body-side recessed part 23 for attaching a metal plate 17 thereto. That is, an outer edge of the yoke 45 is smaller than the toilet-body-side recessed part 23 in a side view. Furthermore, an outer edge of the yoke 45 is larger than an outer edge of the metal plate 17. Furthermore, the yoke 45 is provided in such a manner that a tip of the yoke 45 on a side of the metal plate 17 is flush with the magnet side surface 19*b*. FIG. 7 is a cross-sectional view of a place that corresponds to FIG. 4, in the flush toilet 1 according to a variation. Thereby, a directivity of magnetic field is improved by the yoke 45, so that it is possible to hold the panel member 9 by the magnet 19 that is compact.

Furthermore, a part of the yoke 45 is contained in the toilet-body-side recessed part 23 and is attached to a panel-member-side recessed part 39 so as to be provided outside the magnet 19, so that it is possible to decrease a step between the toilet body 3 and the panel member 9 and attain improvement of a design thereof. Additionally, structures of the magnet 19 and the yoke 45 are not limited thereto where only the magnet lower surface 19*a*, the magnet upper surface 19*d*, the magnet front surface 19*e*, and the magnet back surface 19*f* may be covered without covering the magnet side surface 19*b* or an iron core may be passed through a center of the magnet 19 that is covered by the yoke 45 in a side view in order to improve adsorption force. Furthermore, a length of the yoke 45 in leftward and rightward directions may be greater than that of the magnet side surface 19*b*. Additionally, the yoke 45 does not have to cover the magnet upper surface 19*d* and the magnet lower surface 19*a* where the yoke 45 may be provided so as to extend toward a side of the toilet body 3 in such a manner that the magnet side surface 19*b* is covered and none of the magnet upper surface 19*d* and the magnet lower surface 19*a* is covered from a periphery of the magnet side surface 19*b*.

Although the panel member 9 is attached to a functional part 5 by, for example, a magnet 44 and a metal plate 42 that is adsorbed on the magnet 44 by magnetic force thereof in the flush toilet 1 according to an embodiment as described above, the functional part 5 may also be provided with a configuration that is similar to that of the toilet body 3. Specifically, similarly to an embodiment as described above, a surface of the functional part 5 where the metal plate 42 is attached thereto may be formed so as to be dented inward or a surface of the panel member 9 where the magnet 44 is attached thereto may be formed so as to be dented inward. That is, it is also possible to apply an embodiment as described above to the functional part 5 similarly.

An aspect of the present embodiment aims to decrease a step between a toilet body and a panel member without decreasing magnetic force so as to attain improvement of a design thereof.

A flush toilet according to an aspect of an embodiment is characterized by including a toilet body that has a bowl part that receives waste, a functional part that is provided on a back side of the toilet body, a panel member that covers a side surface of the functional part, a magnet that is provided on one of the panel member and the toilet body, and a magnetic body that is provided on another of the panel member and the toilet body, wherein at least one of the panel member and the toilet body includes an attachment part that has a recessed part for attaching the magnet or the magnetic body thereto.

In such a configuration, a part or a whole of at least one of a magnet and a magnetic body is contained in a recessed part. Thereby, a step between a toilet body and a panel member is decreased without changing a size of a magnet, that is, without decreasing magnetic force thereof so as to attain improvement of a design thereof.

Furthermore, it is characterized in that the toilet body includes a toilet-body-side attachment part that has a toilet-body-side recessed part for attaching the magnet or the magnetic body thereto, and the toilet-body-side attachment part has a lower side supporting surface that forms the toilet-body-side recessed part and is provided on a lower side of the magnet or the magnetic body.

In such a configuration, a magnet or a magnetic body on a side of a toilet body is capable of being supported by a lower side supporting surface. Hence, for example, when a panel member is moved so as to apply downward force to a magnet or a magnetic body on a side of a toilet body, a lower side supporting surface is a drop prevention means for the magnet or the magnetic body on a side of the toilet body.

Furthermore, it is characterized in that a tip of the lower side supporting surface on a side of the panel member protrudes toward a side of the panel member relative to the magnet or the magnetic body that is provided on the toilet-body-side attachment part.

In such a configuration, even if a panel member hangs by its own weight, a lower part of a magnet or a magnetic body that is provided on the panel member contacts a lower side supporting surface. Thereby, it is possible to suppress an amount of a shift of a panel member that is caused by its own weight. Furthermore, a lower side supporting surface is a drop prevention means for a panel member.

Furthermore, it is characterized in that the toilet-body-side attachment part has an upper side supporting surface that forms the toilet-body-side recessed part and is provided on an upper side of the magnet or the magnetic body, an amount of protrusion of the magnet or the magnetic body that is attached to the toilet-body-side attachment part toward the panel member is less than that of a tip of the lower side supporting surface on a side of the panel member, and an amount of protrusion thereof toward the panel member is less than that of a tip of the upper side supporting surface on a side of the panel member.

In such a configuration, for example, when a panel member is cleaned by wiping thereof, and in a case where the panel member is moved relative to a toilet body, a magnet or a magnetic body that is attached to a panel-side attachment part contacts an upper side supporting surface and/or a lower side supporting surface of a toilet-body-side attachment part. Hence, a positional shift of a panel member relative to a toilet body is suppressed, so that the panel member does not drop from the toilet body.

Furthermore, it is characterized in that a part of the magnet or the magnetic body that is attached to a side of the panel member is contained in the toilet-body-side recessed part.

In such a configuration, for example, when a panel member is cleaned by wiping thereof, and in a case where the panel member is moved relative to a toilet body, a magnet or a magnetic body that is attached to a panel-side attachment part contacts an upper side supporting surface and/or a lower side supporting surface of a toilet-body-side attachment part. Hence, a positional shift of a panel member relative to a toilet body is suppressed, so that the panel member does not drop from the toilet body.

Furthermore, it is characterized in that the panel member includes a panel-member-side attachment part that has a panel-member-side recessed part for attaching the magnet or the magnetic body thereto, and an inner side surface that forms the panel-member-side recessed part slopes to increase a thickness of the panel member with increasing a distance from an edge of an attachment surface that attaches the magnet or the magnetic body thereto.

In such a configuration, even if a recessed part is provided in a panel member by molding thereof in order to increase a thickness of a magnet, it is possible to suppress a sink that is a dent that is generated by molding shrinkage.

Furthermore, it is characterized in that, when the panel member is attached to the toilet body, a part of the magnet or the magnetic body that is attached to the toilet body is provided on a side of the panel member relative to a tip of the magnet or the magnetic body that is attached to the panel member in lower side area relative to an upper end of the magnet or the magnetic body that is attached to the panel member.

In such a configuration, it is possible to support a magnet or a magnetic body that is attached to a panel member by a magnet or a magnetic body that is attached to a toilet body. Hence, it is possible to suppress hanging of a panel member that is caused by its own weight.

Furthermore, it is characterized in that the flush toilet includes a yoke that attaches the magnet that is provided on one of the toilet body and the panel member thereto, and covers a periphery of the magnet, wherein, when the panel member is attached to the toilet body, the yoke is contained in the recessed part for attaching the magnetic body thereto.

In such a configuration, it is possible to improve a directionality of magnetic field by a yoke and hold a panel member by a magnet that is compact. Furthermore, a yoke is attached to an inside of an attachment part for attaching a magnetic body thereto so as to penetrate thereinto, so that it is possible to decrease a step between a toilet body and a panel member and it is possible to attain improvement of a design thereof.

In a flush toilet according to a disclosed embodiment, a step between a toilet body and a panel member is decreased without decreasing magnetic force so as to attain improvement of a design thereof.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet, comprising:

a toilet body that includes a bowl part that receives waste;

a functional part that is provided on a back side of the toilet body;

a panel member that covers a side surface of the functional part;

a magnet that is provided on one of the panel member and the toilet body; and a magnetic body that is provided on another of the panel member and the toilet body, wherein the toilet body includes a toilet-body-side attachment part that includes a toilet-body-side recessed part for attaching the magnet or the magnetic body to the toilet-body-side attachment part, and the toilet-body-side attachment part includes a lower side supporting surface that forms the toilet-body-side recessed part and is provided on a lower side of the magnet or the magnetic body, wherein the lower side supporting surface is non-magnetic, and a tip of the lower side supporting surface on a side of the panel member protrudes toward the side of the panel member relative to the magnet or the magnetic body that is provided on the toilet-body-side attachment part.

2. The flush toilet according to claim 1, wherein the toilet-body-side attachment part includes an upper side supporting surface that forms the toilet-body-side recessed part and is provided on an upper side of the magnet or the magnetic body, an amount of protrusion of the magnet or the magnetic body that is attached to the toilet-body-side attachment part toward the panel member is less than an amount of protrusion of the tip of the lower side supporting surface on the side of the panel member, and the amount of protrusion of the magnet or the magnetic body that is attached to the toilet-body-side attachment part toward the panel member is less than an amount of protrusion of the tip of the upper side supporting surface on the side of the panel member.

3. The flush toilet according to claim 2, wherein a part of the magnet or the magnetic body that is attached to the side of the panel member is contained in the toilet-body-side recessed part.

4. The flush toilet according to claim 1, further comprising a yoke that attaches the magnet that is provided on one of the toilet body and the panel member to the yoke, and covers a periphery of the magnet, wherein, when the panel member is attached to the toilet body, the yoke is contained in the recessed part for attaching the magnetic body to the attachment part.

5. The flush toilet according to claim 1, wherein the panel member includes a panel-member-side attachment part that includes a panel-member-side recessed part for attaching the magnet or the magnetic body to the panel-member-side attachment part, and an inner side surface that forms the panel-member-side recessed part slopes to increase a thickness of the panel member with increasing a distance from an edge of an attachment surface that attaches the magnet or the magnetic body to the attachment surface.

6. The flush toilet according to claim 1, wherein, when the panel member is attached to the toilet body, a part of the magnet or the magnetic body that is attached to the toilet body is provided on a side of the panel member relative to a tip of the magnet or the magnetic body that is attached to the panel member in a lower side area relative to an upper end of the magnet or the magnetic body that is attached to the panel member.

7. The flush toilet according to claim 1, further comprising:

another magnetic body that is provided on the functional part; and another magnet that is provided on the panel member at a position that corresponds to a position of the another magnetic body when the panel member is attached to the toilet body.

8. The flush toilet according to claim 7, wherein the functional part includes a functional-part-side attachment part that includes a functional-part-side recessed part for attaching the another magnetic body to the functional-part-side attachment part.

9. The flush toilet according to claim 7, wherein the panel member includes a panel-member-side attachment part that includes a panel-member-side recessed part for attaching the another magnet to the panel-member-side attachment part.

* * * * *